US009365970B2

(12) United States Patent
Hernandez et al.

(10) Patent No.: US 9,365,970 B2
(45) Date of Patent: Jun. 14, 2016

(54) IRONING BOARD WITH EXPANDABLE LEGS

(71) Applicant: Home Products International—North America, Inc., Chicago, IL (US)

(72) Inventors: Rolando Hernandez, Oak Lawn, IL (US); Gabriel Prero, Chicago, IL (US); James Orrico, Chicago, IL (US); Theron Michael Watters, Columbus, IN (US); John P. Cichello, Chicago, IL (US); Mario Orrico, Chicago, IL (US)

(73) Assignee: Home Products International—North America, Inc., Chicago, IL (US)

( * ) Notice: Subject to any disclaimer, the term of this patent is extended or adjusted under 35 U.S.C. 154(b) by 0 days.

(21) Appl. No.: 14/639,922

(22) Filed: Mar. 5, 2015

(65) Prior Publication Data

US 2015/0259850 A1 Sep. 17, 2015

Related U.S. Application Data

(60) Provisional application No. 61/952,668, filed on Mar. 13, 2014.

(51) Int. Cl.
*D06F 81/04* (2006.01)
*A47B 3/02* (2006.01)

(52) U.S. Cl.
CPC . *D06F 81/04* (2013.01); *A47B 3/02* (2013.01); *A47B 2200/0015* (2013.01)

(58) Field of Classification Search
CPC ..... D06F 81/00; D06F 81/02; D06F 81/04; A47B 9/16; A47B 3/02; A47B 3/002; A47B 3/0815; A47B 2003/006; A47B 2003/025; A47B 13/02; A47B 21/02; A47B 2200/0015
See application file for complete search history.

(56) References Cited

U.S. PATENT DOCUMENTS 1,098,682 A * 6/1914 Pope ..... A47B 3/12 108/101
1,448,937 A * 3/1923 O'Brien ..... D06F 81/02 108/122
1,656,396 A * 1/1928 Schade ..... D06F 81/04 108/29
2,466,556 A * 4/1949 Picken ..... D06F 81/02 108/123
2,493,018 A * 1/1950 O'Connor ..... D06F 81/02 108/123
2,671,974 A * 3/1954 McKinnie ..... D06F 81/04 108/117
2,683,944 A * 7/1954 Kiel ..... D06F 81/04 108/117
2,696,686 A * 12/1954 Hartman ..... D06F 81/02 108/122
2,912,775 A * 11/1959 Gettelman ..... D06F 81/04 108/117
4,821,650 A * 4/1989 Simpson ..... B21D 53/00 108/117
8,776,411 B2 * 7/2014 Ducruet ..... D06F 81/02 108/120

* cited by examiner

*Primary Examiner* — Ismael Izaguirre
(74) *Attorney, Agent, or Firm* — Neal, Gerber & Eisenberg, LLP

(57) ABSTRACT

Various embodiments of the present disclosure include an ironing board with two expandable front legs configured to expand to a wider separation in an open position than in a collapsed position. The wider separation in the open position allows for greater stability without increasing the size of the board in the collapsed position. The ironing board of the present disclosure includes a front leg pivot system that permits each of the front legs to spread apart from each other and an adjustable pivot mechanism that allows the front legs to move apart from the rear legs. In one embodiment, a cam is mounted to the two rear legs to serve as a track for the front legs. In another embodiment, a tension member is mounted to the two front legs to control the spread of the two front legs.

20 Claims, 7 Drawing Sheets

IRONING BOARD WITH EXPANDABLE LEGS

CROSS-REFERENCE TO RELATED APPLICATIONS

This application claims priority to U.S. Provisional Application No. 61/952,668, filed on Mar. 13, 2014 and entitled "Ironing Board with Expandable Legs," which is incorporated herein by reference in its entirety.

TECHNICAL FIELD

The present disclosure relates to ironing board, and more specifically, to ironing boards with expandable legs.

BACKGROUND

Ironing boards, and in particular four-legged ironing boards, are well known in the household products field. In order to allow compact storage of the ironing board in a small space such as a closet, it is important that the ironing board can collapse from the ironing position to provide a small footprint both in regard to the height and width dimensions. It is known in the art to provide ironing boards with a front pair of legs and a rear pair of legs, such that each pair of legs pivots about an axle and moves to expand to an open position and collapse to a closed position. Such collapsibility through the use of the two pairs of legs allow for the front and rear pairs of legs to fold up towards the underside of the board for storing the board in a generally flat position. Existing ironing boards which comprise such front and rear pairs of legs are able to collapse to generally the same width as the ironing board. As such, existing ironing boards are limited to having front and rear pairs of legs with a width approximately equal to the width of the board itself. While existing ironing boards can stand in a fairly stable position given this limitation in leg width, improved stability is desirable given that the necessary movements for ironing a piece of fabric often rocks or tilts the board. However, in existing ironing boards increasing the spread of the pairs of legs would increase the footprint of the collapsed board. Thus, it would be advantageous to provide an ironing board with a wider base to increase stability of the board without increasing the footprint of the collapsed board and without the need for the user to maneuver the legs in any other manner than the unfolding of the board.

SUMMARY

The present invention solves the existing limitations. The present invention relates to an ironing board with expandable legs that, when collapsed, provides the same small footprint as a standard ironing board for convenient storage.

In a standard four-legged ironing board, the two front legs are attached to each other by a single axle and positioned a fixed distance apart along said axle, causing both front legs to move together as one and remain in one plane. More specifically, in a closed (or collapsed) position, the two front legs are the fixed distance apart from one another, and the two front legs are folded up against the underside of the ironing board. From the closed position, the two front legs move together as one, away from the ironing board, to expand to an open position. In the open position, the two front legs are still the same fixed distance apart from each other. Thus, because both legs are fixedly attached to each other about the single axle, the distance between both of the front legs remains the same, whether in the collapsed position or in the expanded position.

By contrast, various embodiments of the present disclosure include a front leg pivot system in which each of the two front legs of the ironing board are mounted to the underside of the ironing board at two different mounting positions. The front legs are connected to each other with a flexible axle that bends to permit each of the front legs to rotate on two planes. First, both legs are configured to move in a first plane away from the board and towards the board to respectively open and collapse the ironing board. Second, each front leg is configured to move in a second plane away from the other front leg to expand to a wider separation between the two legs when the ironing board is in an open position, and move toward the other front leg when collapsing into a closed position.

Additionally, in a standard four-legged ironing board, the two front legs are fixedly secured to the two rear legs by a fixed axle running through all four legs. Accordingly, the width of separation between the front legs is fixed relative to the width of separation between the rear legs. By contrast, the ironing board of the present disclosure includes an adjustable pivot mechanism that connects the two front legs to the outside of each of the two rear legs. The adjustable pivot mechanism allows the front legs to expand wider than the width of the separation between the two rear legs when the ironing board is in the open position. Specifically, the adjustable pivot mechanism allows the two front legs to slide away from the two respective rear legs and spread apart as the ironing board is moved to the open position. It should be appreciated, that the front legs remain in the same plane and move together as a single unit.

In some embodiments, the adjustable pivot mechanism includes two separate axles, each axle having a first end that is fixedly coupled to a respective one of the front legs. The two-axle pivot mechanism further includes a receiving hole in each of the rear legs for slidably receiving a second end of a respective one of the two axles. As the two front legs move from a closed position to an open position, each of the axles are pulled outward, or in opposing directions, through the holes in the rear legs, thus enabling the front legs to spread to a wider width than when in a closed position.

In other embodiments, the adjustable pivot mechanism includes a single axle that is slidably coupled to each of the front legs and the rear legs. The single-axle pivot mechanism further includes a receiving hole in each of the front legs and the rear legs for slidably receiving the single axle there through. A first end of the single axle extends from an outer side of the receiving hole in a first front leg, and a second end of the single axle extends from an outer side of the receiving hole in a second front leg. As the two front legs move from a closed position to an open position, the front legs glide along the single axle, towards the rear legs during a closing operation and away from the rear legs during an opening operation. A set of fasteners can be coupled to each end of the single axle to keep the front legs from sliding off of the single axle.

In embodiments, a cam is mounted to the two rear legs at the location of the pivot mechanism. This cam serves as a track for the front legs, controlling their spread evenly and smoothly. As the front legs are deployed, they ride along a scalloped edge of the cam, such that as the width of the cam increases due to the shape of the cam, so does the spread of the front legs.

In certain embodiments of the present disclosure, the ironing board further comprises a tension member, such as a spring, bungee, or elastic cable, mounted between the two front legs. In a preferred embodiment the tension member is positioned near the feet of the front legs. The tension member in its compressed neutral position keeps the front legs tight against the cam, preventing the legs from spreading open more than intended, or prematurely. When the legs are deployed, the tension member stretches to allow the legs to deploy along the cam and into the full open position. When the board is collapsed, the tension member aids in pulling the legs back together. Thus, as the legs ride along the cam and get closer together, and, when fully closed, they are no farther apart than a typical four-legged board in the collapsed position for storage. Tension member may be housed within a housing for protection from damage as well as aesthetic purposes.

It should be appreciated that the benefit of having legs that spread apart further in an open position than in the closed position as opposed to static boards that are simply built with a wider stance, is that in storage the board requires less space. It is also more convenient and more efficient to ship and has less risk of breakage.

Other objects, advantages, features, properties and relationships of the invention will be obtained from the following detailed description and accompanying drawings which set forth illustrative embodiments that are indicative of the various ways in which the principles of the invention may be employed.

DETAILED DESCRIPTION

The description that follows describes, illustrates and exemplifies one or more embodiments of the present invention in accordance with its principles. This description is not provided to limit the invention to the embodiments described herein, but rather to explain and teach the principles of the invention in order to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

Various embodiments of the present disclosure are directed to an ironing board with expandable legs that spread apart wider in an open position than when in a closed (or collapsed) position in order to increase the overall stability of the ironing board in the open position. When moving from an open position to the closed position, the expanded legs retract back to a narrower spread for easy storage.

Figure 1:
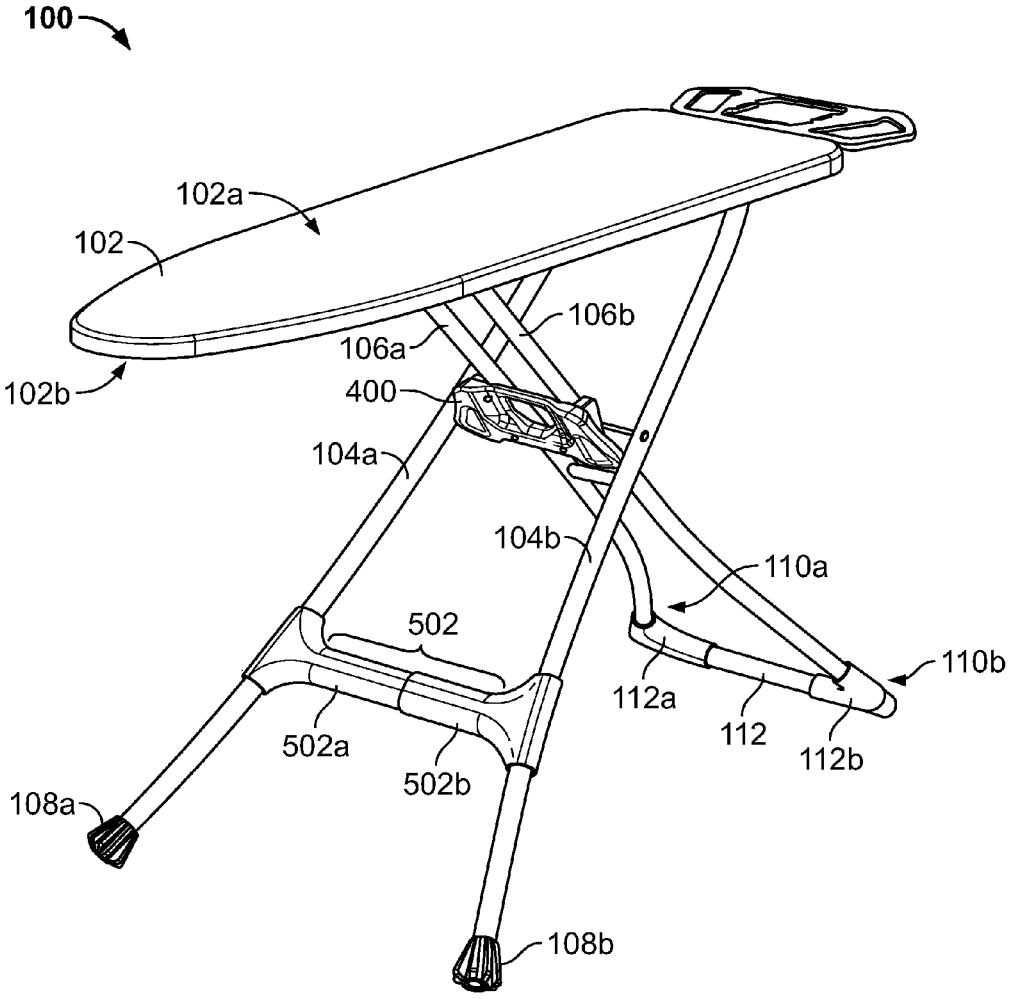
FIG. 1 is a front perspective view of an ironing board with expandable legs in a deployed position in accordance with certain embodiments.

As shown in FIG. 1, in a preferred embodiment of the present disclosure, an ironing board 100 includes a board 102, two expandable front legs 104*a*. 104*b*, and two rear legs 106*a*, 106*b*. The board 102 includes a topside 102*a* and an underside 102*b*. The two front legs include two feet 108*a*, 108*b* at the bottom of the front legs 104*a*, 104*b*. The two rear legs 106*a*, 106*b* include two feet 110*a*, 110*b*, at the bottom of the two rear legs 106*a*, 106*b*. In one embodiment, as shown in FIG. 1, the feet 110*a*, 110*b* of the two rear legs 106*a*, 106*b* are connected by a rear feet connection bar 112. In certain embodiments, the rear legs 106*a*, 106*b* and the rear feet connection bar 112 are encased in a housing such as the housing 112*a*, 112*b* depicted in FIG. 1. The two front legs 104*a*, 104*b* are affixed to the outside, or outer edges, of the rear legs 106*a*, 106*b*, respectively.

Figure 2:
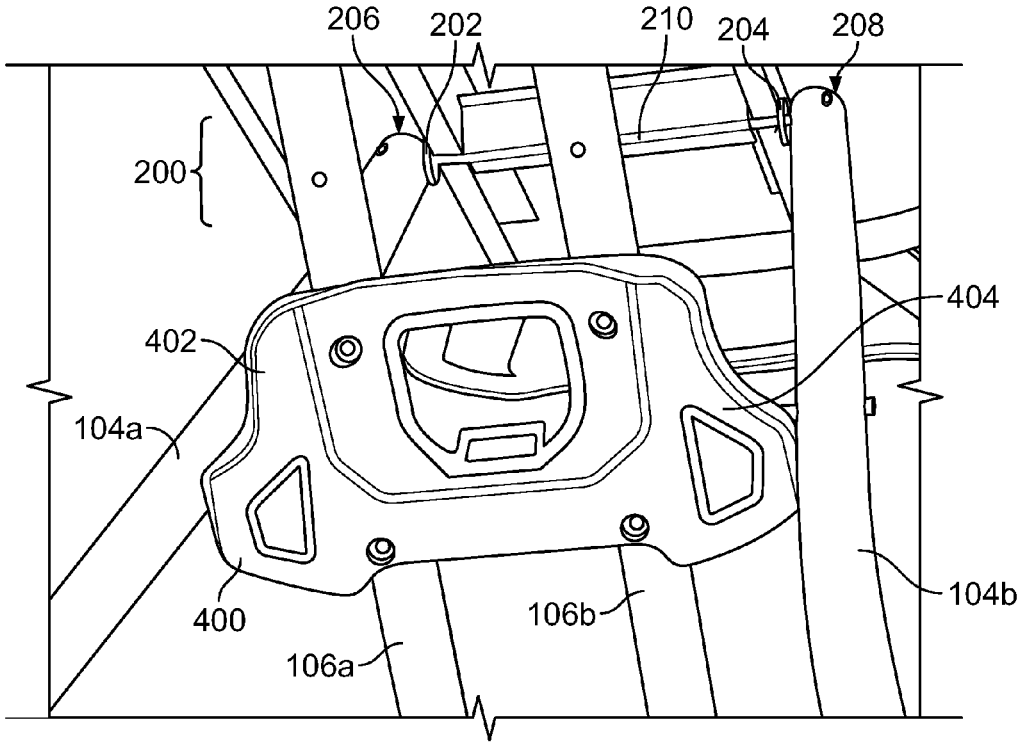
FIG. 2 is a front perspective view of a cam and a pivot mechanism of an ironing board with expandable legs in a deployed position in accordance with certain embodiments.

As shown in FIG. 2, the ironing board 100 of the present disclosure includes a front leg pivot system 200. The front leg pivot system 200 includes two mounting points 202, 204 for each of the two front legs 104*a*, 104*b*, respectively. At each mounting point 202, 204, the respective front leg 104*a*, 104*b* is hinged to the underside of the board 102. More specifically, at the first mounting point 202, a first hinge 206 mounts the first front leg 104*a* to the underside of the board 102. At the second mounting point 204, a second hinge 208 mounts the second front leg 104*b* to the underside of the board 102. The hinges 206, 208 at the top allow the front legs 104*a*, 104*b* to rotate away from the board 102 in order to deploy from a closed position to an open position, as a standard ironing board does. The two front legs 104*a*, 104*b* are connected to each other by a flexible axle 210 that bends to permit the two legs 104*a*, 104*b* to move apart in a different plane, away from each other.

As shown in FIGS. 1 and 2, a cam 400 is also mounted to the rear legs 106*a*, 106*b* The cam 400 serves as a track for the front legs 104*a*, 104*b* to move along during deployment and collapse of the ironing board 100 and is configured to control the spread of the front legs 104*a*, 104*b* evenly and smoothly. More specifically, the cam 400 includes scalloped edges 402, 404 that form a narrower shape at a top of the cam 400 and a wider shape at a bottom of the cam 400, as shown in FIG. 2. In a closed position, the front legs 104*a*, 104*b* are positioned adjacent to the narrower, top portion of the cam 400. As the front legs 104*a*, 104*b* are deployed from the closed position to an open position, the front legs 104*a*, 104*b* ride or glide along the scalloped edges 402, 404, respectively, towards the wider, bottom portion of the cam 400. As the shape of the cam 400 gets wider, the width of the spread between the two front legs 104*a*, 104*b* increases. When the board 102 is collapsed, the front legs 104*a*, 104*b* glide along the cam 400 in the opposite direction, and the width of the spread between the front legs 104*a*, 104*b* decreases as the width of the cam 400 narrows. While the illustrated embodiment shows the cam 400 positioned adjacent to the pivot mechanism 300 of FIG. 3, or the pivot mechanism 900 of FIG. 9, it will be appreciated that the cam 400 may be placed at other locations along the rear legs 104*a*, 104*b* in accordance with the techniques and principles described herein.

Figure 3:
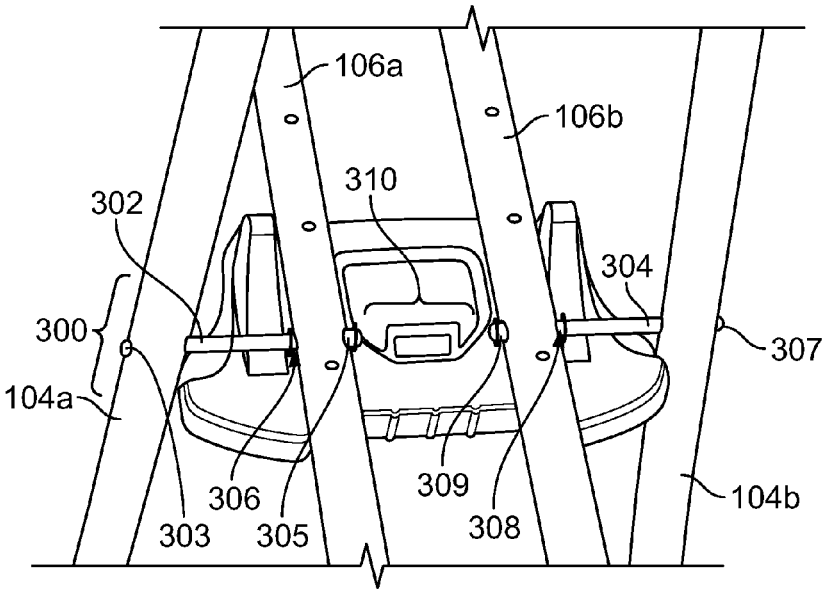
FIG. 3 is a rear perspective view of a cam and a pivot mechanism of an ironing board with expandable legs in a deployed position in accordance with certain embodiments.

Referring now to FIG. 3, shown is an embodiment of the ironing board 100 with an adjustable pivot mechanism 300 located adjacent to, or behind, the cam 400. The adjustable pivot mechanism 300 (also referred to herein as a "two axle pivot mechanism") couples each of the front legs 104*a*, 104*b* to an outside of a respective one of the rear legs 106*a*, 106*b*. In the illustrated embodiment, the pivot mechanism 300 includes two pivot axles 302, 304 and an open center 310 between the two rear legs 106*a*, 106*b*. As shown, the first pivot axle 302 includes a first or outer end 303 that is fixedly coupled to the first front leg 104*a* and a second or inner end 305 that is slidably coupled to a first hole 306 in the first rear leg 106*a*, such that the second end 305 can move through the first hole 306. Likewise, the second pivot axle 304 includes a first or outer end 307 that is fixedly coupled to the second front leg 104*b* and a second or inner end 309 that is slidably coupled to a second hole 308 in the second rear leg 106*b*, such that the second end 309 can move through the second hole 308. The two-axle pivot mechanism 300 allows the two pivot axles 302, 304 to pass through the rear legs 106*a*, 106*b* and, during a closing operation, move together, or slide towards each other, within the space formed by the open center 310 and, during an opening operation, move away, or slide apart, from each other to accommodate the spreading of the front legs 104*a*, 104*b*.

Figure 4:
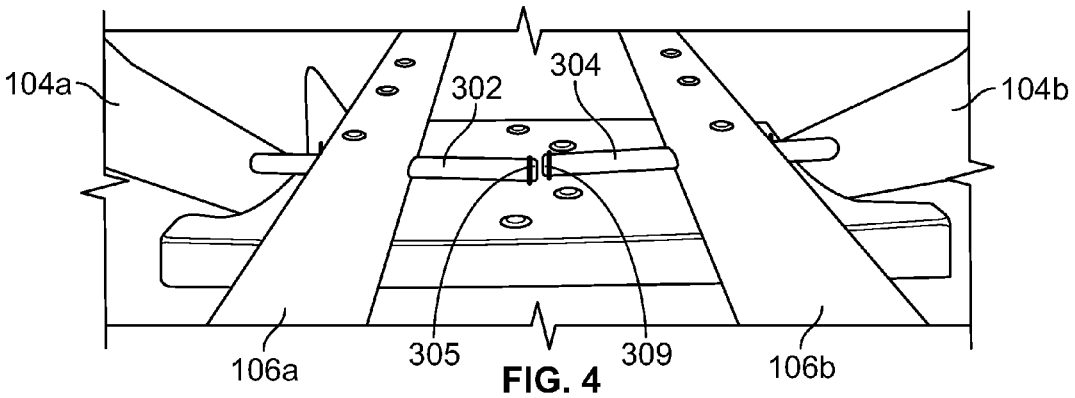
FIG. 4 is a side view of the embodiment of FIG. 3 with expandable legs in a collapsed position.

As shown in FIG. 4, when the ironing board 100 is in the collapsed position, the pivot axles 302, 304 are positioned adjacent each other within the open center 310 between the rear legs 106*a*, 106*b* (e.g., such that the second ends 305 and 309 are nearly touching). As shown in FIG. 3, when the ironing board 100 is in the deployed position, the front legs 104*a*, 104*b* are spread apart and away from the rear legs 106*a*, 106*b*. In this deployed position, the pivot axles 302, 304 have passed through the holes 306, 308 of the rear legs 106*a*, 106*b* and away from the open center 310 (e.g., such that only the second ends 305 and 309 are with the open center 310). It should be appreciated that the two axle pivot mechanism 300 keeps the front legs 106*a*, 106*b* moving in the same plane, or along an axis of the pivot mechanism 300, and together as a single unit, during both the opening and closing operations. In a preferred embodiment, the front legs 106*a*, 106*b* spread apart at least 6 inches, or 4 to 6 degrees, providing a much wider stance in the front of the ironing board 100, which highly increases the side-to-side stability of the ironing board 100. In a preferred embodiment, the two axles 302, 304 are encased in a single metal tube for protection thereof and to ensure proper alignment and smoother movement.

Figure 9:
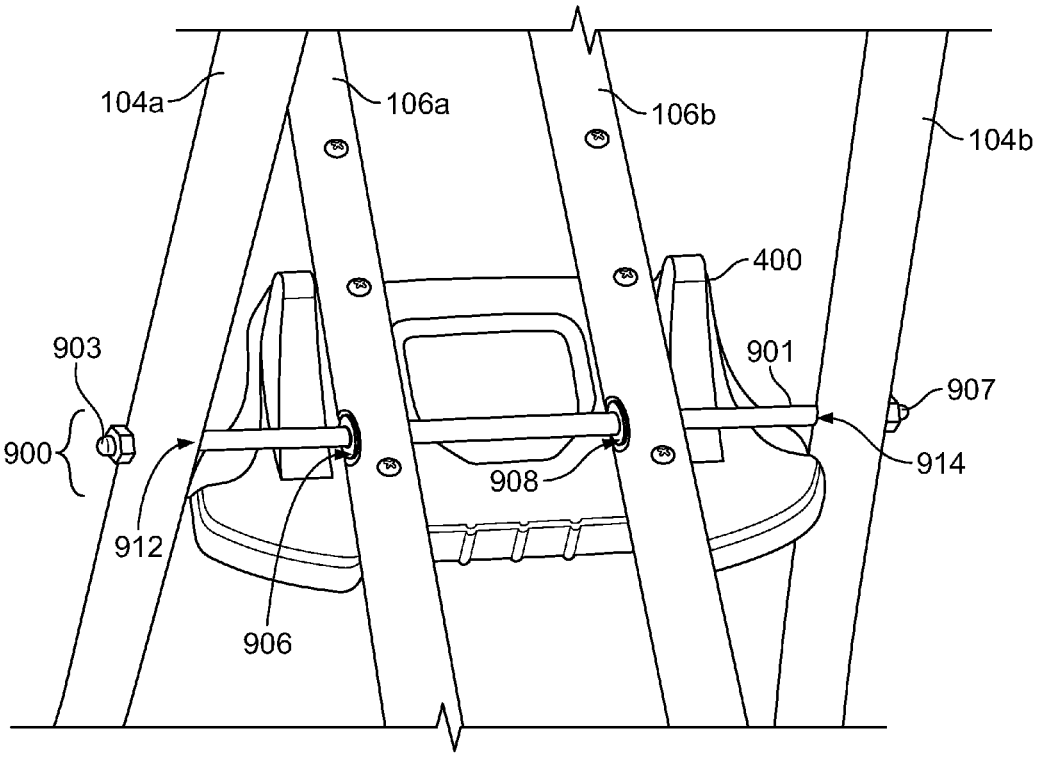
FIG. 9 is a rear perspective view of a cam and a pivot mechanism of an ironing board with expandable legs in a deployed position in accordance with certain embodiments.
Figure 10:
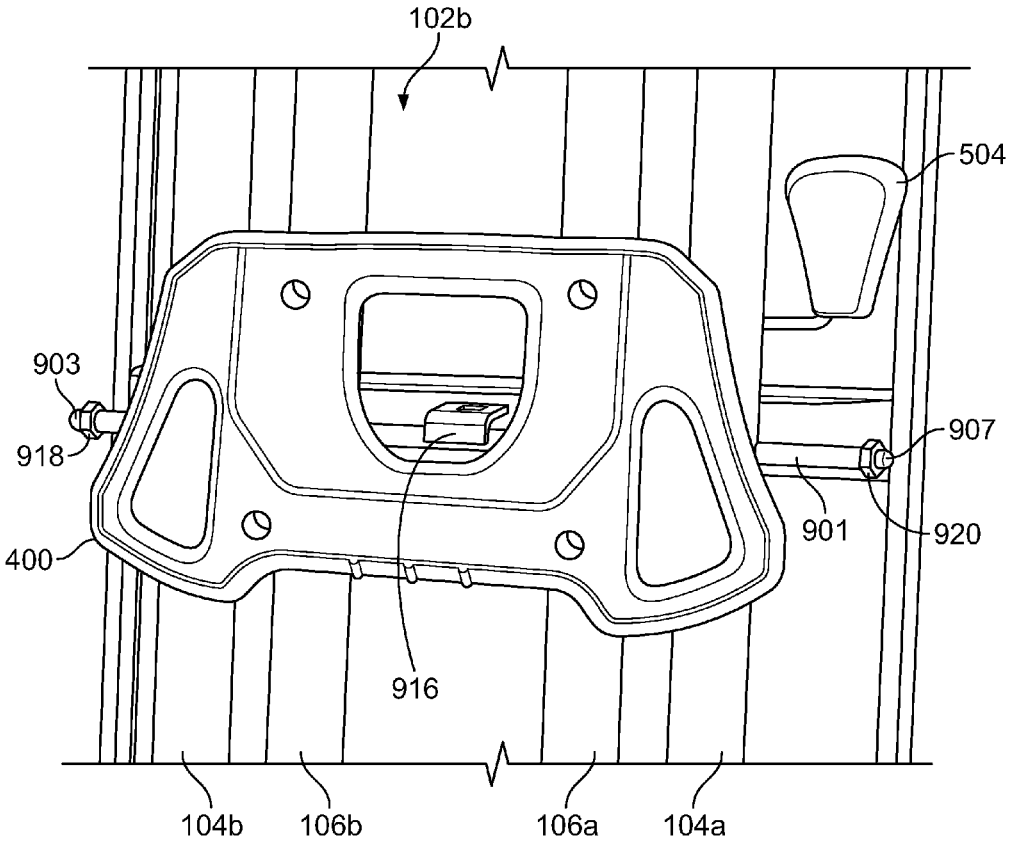
FIG. 10 is a front perspective view of the embodiment of FIG. 9 with expandable legs in a collapsed position.

Referring now to FIGS. 9 and 10, shown in another embodiment of the ironing board 100 with an adjustable pivot mechanism 900 located adjacent to, or behind, the cam 400. The adjustable pivot mechanism 900 (also referred to herein as a "single axle pivot mechanism") couples each of the front legs 104*a*, 104*b* to an outside of a respective one of the rear legs 106*a*, 106*b*. In the illustrated embodiment, the pivot mechanism 900 includes a single pivot axle 901 having a first end 903 that is slidably coupled to an outside of the first front leg 104*a* at a first front leg hole 912 and a second end 907 that is slidably coupled to an outside of the second front leg 104*b* at a second front leg hole 912. The single axle pivot mechanism 900 further includes a first rear leg hole 906 in the first rear leg 106*a* and a second rear leg hole 908 in the second rear leg 106*b*, each of the holes 906 and 908 slidably receiving the single axle 901 there through.

As shown in FIG. 10, when the ironing board 100 is in the collapsed position, the front legs 104*a*, 104*b* move inward, or slide towards each other, along the single axle 901 until positioned adjacent to the rear legs 106*a*, 106*b* and behind the cam 400. In this collapsed position, the first end 903 and the second end 907 fully extend out from the front leg holes 912 and 914, such that the ends 903 and 907 are floating on either side of the cam 400. As shown in FIG. 9, when the ironing board 100 in the deployed position, the front legs 104*a*, 104*b* move outward, or slide apart, along the single axle 901 until positioned adjacent to the first end 903 and second end 907, respectively, on either side of the cam 400. In embodiments, as the ironing board 100 moves between the collapsed and deployed positions, only the front legs 104*a*, 104*b* move along the single axle 901, and the rear legs 106*a*, 106*b* remain substantially still or at the same general position along the single axle 901. As shown in FIG. 10, in some cases, the pivot mechanism 900 further includes a bracket 916 at center of the single axle 901 to lock, or retain, the front legs 104*a*, 104*b* to the underside 102*b* of the board 102 in the collapsed position.

As shown in FIGS. 9 and 10, the pivot mechanism 900 can further include a pair of fasteners 918 and 920 coupled to the first end 903 and the second end 907, respectively, to keep the single axle 901 from slipping out of the front leg holes 912 and 914. The fasteners 918, 920 can be screws, nuts, or any other suitable mechanism for keeping the ends 903, 907 of the single axle 901 coupled to the front legs 104*a*, 104*b*. It should be appreciated that the single axle pivot mechanism 900 keeps the front legs 106*a*, 106*b* moving in the same plane, or along an axis of the pivot mechanism 900, and together as a single unit, during both the opening and closing operations. In a preferred embodiment, the front legs 106*a*, 106*b* spread apart at least 6 inches, or 4 to 6 degrees, providing a much wider stance in the front of the ironing board 100, which highly increases the side-to-side stability of the ironing board 100.

Figure 5:
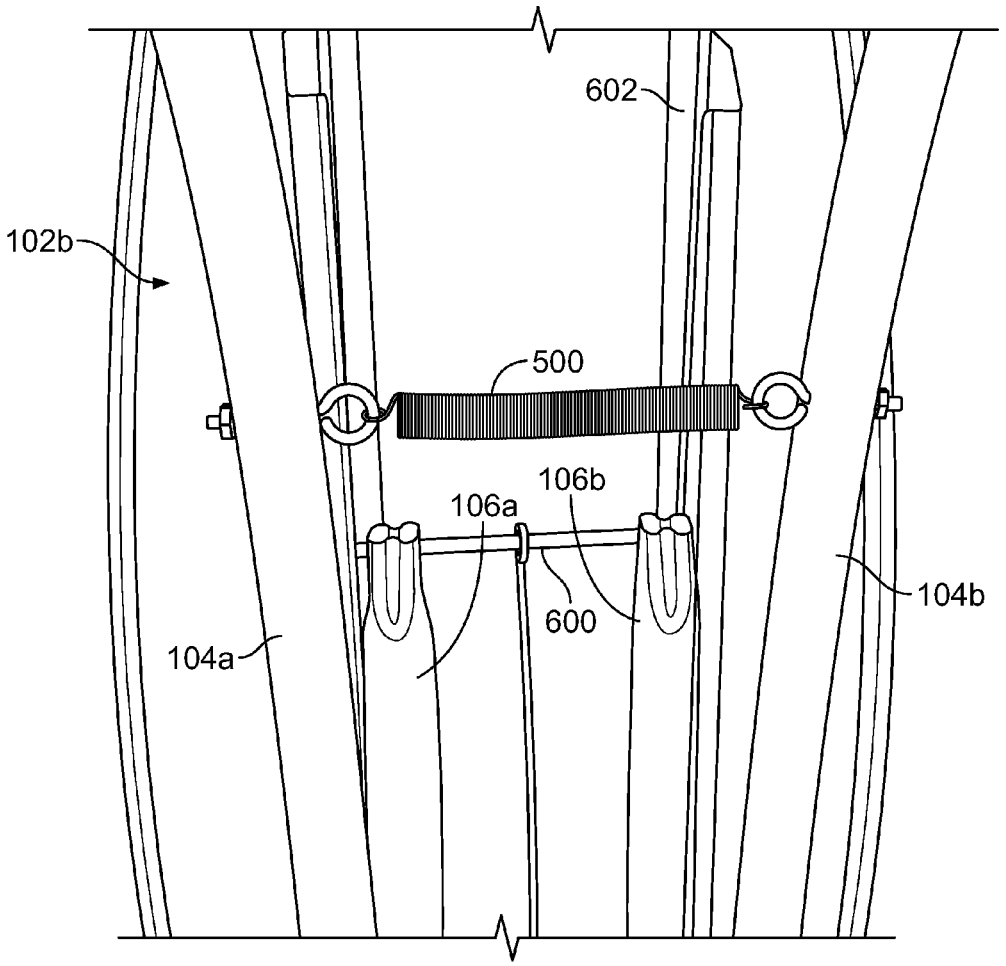
FIG. 5 is a bottom view of a tension member of an ironing board with expandable legs in a collapsed position in accordance with certain embodiments.

As shown in FIG. 5, the rear legs 106*a*, 106*b* are slidably mounted to the underside 102*b* of the board 102 via a single-rod front axle 600 which slides along a track 602, allowing the rear legs 106*a*, 106*b* to slide along the underside 102*b* of the board 102 for opening to a standing or deployed position and folding into a collapsed position. In some embodiments, the ironing board 100 includes a single rear leg (not shown) that is slidably mounted to the underside 102*b* of the board 102 via the front axle 600. The single rear leg may be positioned between the front legs 106*a*, 106*b* when in the deployed position. The adjustable pivot mechanism 900 may be slidably coupled to the front leg holes 912 and 914 in each of the front legs 106*a*, 106*b*, as described above, and to corresponding rear leg holes in the rear leg, to allow the front legs 106*a*, 106*b* to spread apart when in the deployed position.

Figure 6:
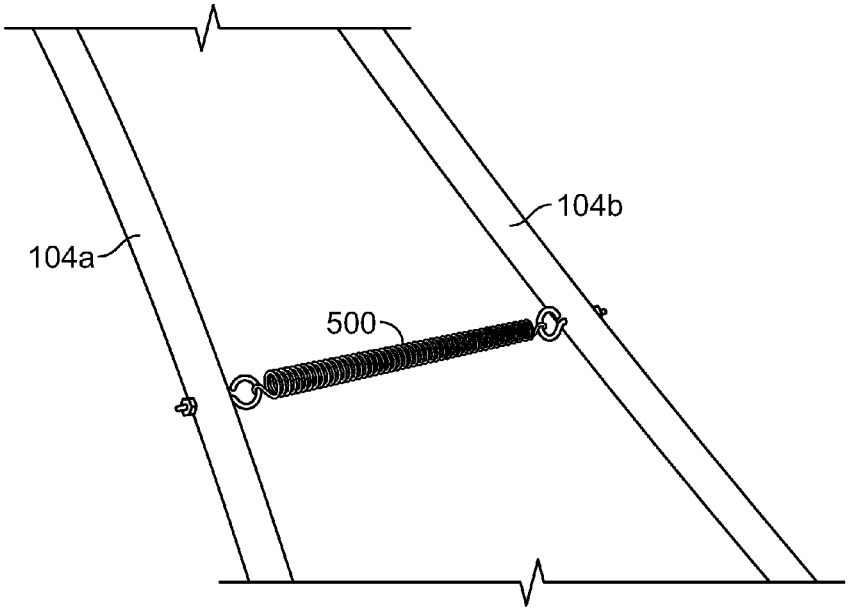
FIG. 6 is a front perspective view of the embodiment of FIG. 5 with expandable legs in a deployed position.
Figure 7:
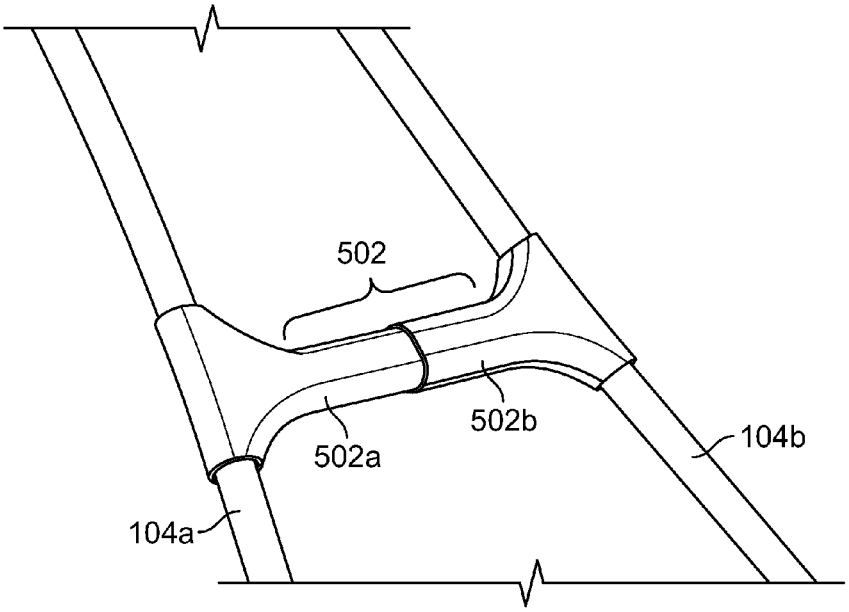
FIG. 7 is a front perspective view of a tension member housed within a housing of an ironing board with expandable legs in a deployed position in accordance with certain embodiments.
Figure 8:
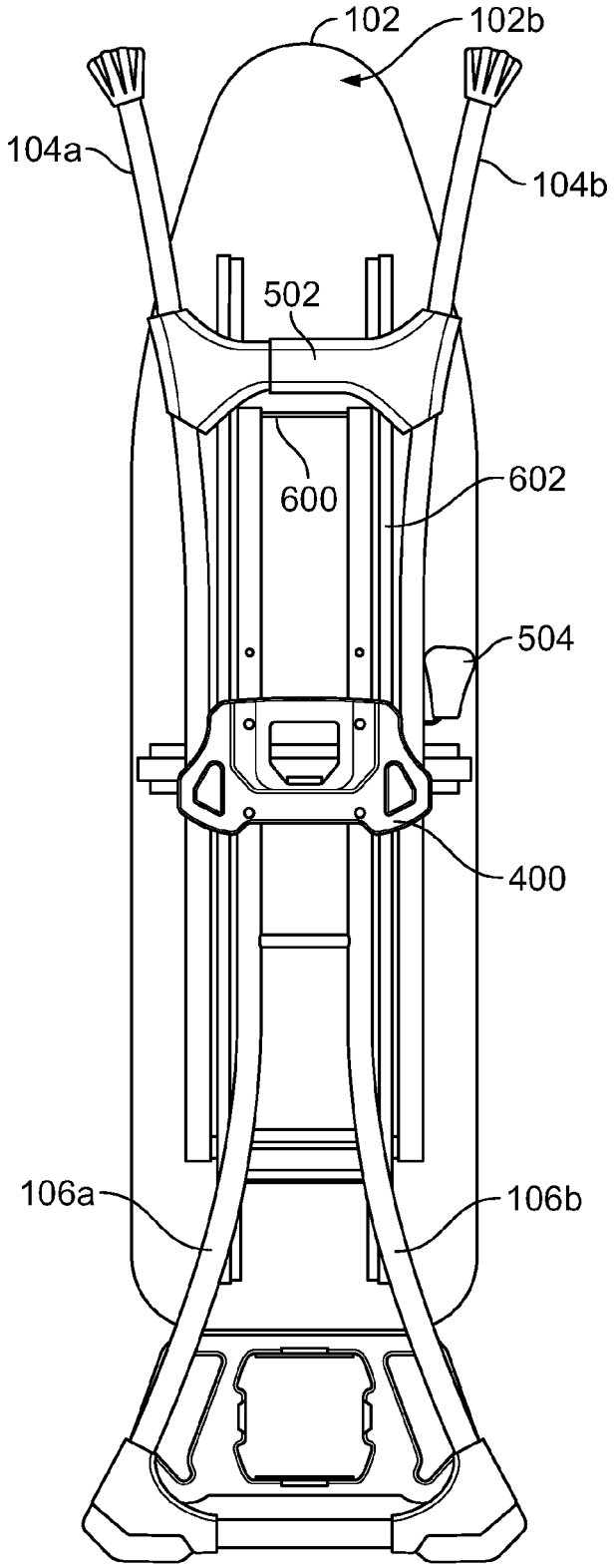
FIG. 8 is a bottom view of an ironing board with expandable legs in a collapsed position in accordance with certain embodiments.

As shown in FIGS. 5, 6 and 7, the ironing board 102 of the present disclosure may further comprise a tension member 500 mounted between the two front legs 104*a*, 104*b*. In various embodiments, the tension member 500 may be comprised of a spring (as shown in FIGS. 5-6), a bungee, or an elastic cable. As seen in FIG. 5, in its compressed neutral position, the tension member 500 keeps the front legs 104*a*, 104*b* tightly closed, and against or under the cam 400 as shown in FIG. 8, preventing the front legs 104*a*, 104*b* from spreading open more than intended, or prematurely. When the front legs 104*a*, 104*b* are deployed, the tension member 500 stretches to allow the front legs 104*a*, 104*b* to deploy along the cam 400 and into the full open position (see FIGS. 1 and 6). When the front legs 104*a*, 104*b* move from an open position to a closed position, the tension member 500 pulls the front legs 104*a*, 104*b* back together, overpowering the cam 400 that was previously forcing the legs 104*a*, 104*b* apart. During this closing operation, the front legs 104*a*, 104*b* ride or glide along the cam 400 as the legs 104*a*, 104*b* move closer together. In a preferred embodiment, when the ironing board 100 is fully closed, the front legs 104*a*, 104*b* are no farther apart than a typical 4 legged ironing board in the collapsed storage position, as shown in FIG. 8.

As shown in FIGS. 1-3 and 7-8, a housing 502 may be placed over tension member 500 for added protection and for a more pleasing aesthetic look. In a preferred embodiment, the housing 502 is comprised of a first portion 502*a* and a second portion 502*b*. The first portion 502*a* is connected to the first front leg 104*a* and the second portion 502*b* is connected to the second front leg 104*b*. The first portion 502*a* and the second portion 502*b* are slidably connected to each other such that one of the portions 502*a*, 502*b* can slide over the other of the portions 502*a*, 502*b* as the front legs 104*a*, 104*b* widen and narrow between the deployed and collapsed positions, respectively. As a result, a total length of the housing 502 can be slidably adjustable, e.g., increased or decreased, to accommodate the varying length of the tension member 500 contained therein as the front legs 104*a*, 104*b* are moved between the deployed and collapsed positions.

As shown in FIG. 8, when the ironing board 100 is in the closed position, the expandable front legs 104*a*, 104*b* retract to the unexpanded position, providing a closed footprint that is similar to that of a standard ironing board. A lever 504 provides a user friendly lock and release system such that no special maneuvering is required to operate the expandable front legs 104*a*, 104*b*. The cam 400, tension member housing 502, and rear leg housing 112*a*, 112*b* are preferably constructed with a durable plastic to provide extra protection when the ironing board is being stored.

It should be appreciated that the wider spread of the front legs in the open position increases the stability of the ironing board of the present disclosure.

Thus, the existing invention provides an ironing board 100 with front legs 104*a*, 104*b* that form a wider base when in an open position to increase stability of the ironing board 100, but do not increase the footprint of the ironing board 100 when in a collapsed position (see FIG. 8) and do not require additional maneuvering of the front legs 104*a*, 104*b* other than the unfolding of the ironing board 100 in the standard manner.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. An ironing board having a collapsed position for storage and a deployed position for use during ironing, the ironing board comprising:

a board, said board including a top side and an underside;

at least one rear leg slidably coupled to the underside of the board to allow movement of the rear leg along the underside of the board;

a pair of front legs including a first front leg and a second front leg, the pair of front legs rotatably coupled to the underside of the board by a front leg axle to allow rotation of the front legs about the front leg axle and movement of the front legs along an axis of the front leg axle; and a pivot mechanism coupling the pair of front legs to the at least one rear leg and enabling the pair of front legs to slide apart along an axis of the pivot mechanism as the ironing board is moved to the deployed position.

2. The ironing board of claim 1, wherein the pivot mechanism comprises a single pivot axle slidably coupled to each of the front legs and the rear leg, the first and second front legs sliding in opposite directions along the single pivot axle as the ironing board is moved to the deployed position.

3. The ironing board of claim 2, wherein as the ironing board is moved to the collapsed position, the first and second front legs slide towards each other along the single pivot axle.

4. The ironing board of claim 1, wherein the at least one rear leg includes a first rear leg and a second rear leg.

5. The ironing board of claim 4, wherein the pivot mechanism comprises:

a first pivot axle affixed to the first front leg and slidably moveable through a first hole in the first rear leg; and a second pivot axle affixed to the second front leg and slidably moveable through a second hole in the second rear leg, wherein as the ironing board moves to the deployed position, the first pivot axle and the second pivot axle move in opposite directions along the axis of the pivot mechanism.

6. The ironing board of claim 5, wherein the first pivot axle and the second pivot axle are adjacent in the collapsed position.

7. The ironing board of claim 1, further comprising a cam affixed to the at least one rear leg for guiding the movement of the front legs between the collapsed position and the deployed position.

8. The ironing board of claim 7, wherein the cam comprises a top first width corresponding to a distance between the front legs in the collapsed position, and a bottom second width corresponding to a distance between the front legs in the deployed position.

9. The ironing board of claim 1, further comprising a tension member coupled between the front legs and configured to hold the front legs together when the tension member is in a compressed state and to push the front legs apart when the tension members is in an expanded state, the compressed state corresponding to the closed position and the expanded state corresponding to the deployed position.

10. The ironing board of claim 9, wherein the tension member is contained within a housing.

11. The ironing board of claim 10, wherein the housing comprises a first member affixed to the first front leg and a second member affixed to the second front leg, and wherein the first and second members are slidably connected to one another such that the housing correspondingly widens with the front legs to accommodate the tension member in the expanded state and correspondingly narrows with the front legs to accommodate the tension member in the compressed state.

12. An ironing board having a collapsed position for storage and a deployed position for use during ironing, the ironing board comprising:

a board, said board including a top side and an underside;

at least one rear leg slidably coupled to the underside of the board to allow movement of the at least one rear leg along the underside of the board;

a pair of front legs including a first front leg and a second front leg, the pair of front legs rotatably coupled to the underside of the board; and a pivot mechanism slidably coupling the pair of front legs to the at least one rear leg using at least one pivot axle, wherein the pair of front legs move apart from each other as the ironing board is moved to the deployed position and move closer together as the ironing board is moved to the collapsed position.

13. The ironing board of claim 12, wherein the at least one rear leg includes a first rear leg and a second rear leg.

14. The ironing board of claim 13, wherein the at least one pivot axle includes:

a first pivot axle affixed to the first front leg and slidably coupled to the at least one rear leg, and a second pivot axle affixed to the second front leg and slidably coupled to the at least one rear leg, wherein as the ironing board is moved between the deployed and collapsed positions, the first pivot axle moves relative to the first rear leg and the second pivot axle moves relative to the second rear leg.

15. The ironing board of claim 12, wherein the at least one pivot axle is slidably coupled to each of the front legs and the at least one rear leg, the first and second front legs sliding along the at least one pivot axle as the ironing board is moved between the collapsed and deployed positions.

16. The ironing board of claim 12, further comprising a cam affixed to the at least one rear leg for guiding the movement of the front legs between the collapsed position and the deployed position.

17. The ironing board of claim 16, wherein the cam comprises a top first width corresponding to a distance between the front legs in the collapsed position, and a bottom second width corresponding to a distance between the front legs in the deployed position.

18. The ironing board of claim 12, further comprising a tension member coupled between the front legs, the tension member holding the front legs together when in a compressed state corresponding to the collapsed position and pushing the front legs apart when in an expanded state corresponding to the deployed position.

19. The ironing board of claim 12, further comprising a front leg axle coupling the pair of front legs to the underside of the board and allowing rotation of the front legs about the front leg axle and movement of the front legs about the at least one pivot axle.

20. The ironing board of claim 12, wherein the at least one rear leg and the pair of front legs are configured to rotate about the pivot mechanism while moving between the collapsed position and the deployed position.

* * * * *